US009407014B2

(12) United States Patent
Tanaka

(10) Patent No.: US 9,407,014 B2
(45) Date of Patent: Aug. 2, 2016

(54) ANTENNA DEVICE

(71) Applicant: MURATA MANUFACTURING CO., LTD., Kyoto (JP)

(72) Inventor: Hiroya Tanaka, Kyoto (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 173 days.

(21) Appl. No.: 14/068,953

(22) Filed: Oct. 31, 2013

(65) Prior Publication Data

US 2014/0118214 A1 May 1, 2014

(30) Foreign Application Priority Data

Oct. 31, 2012 (JP) ..... 2012-240832
Oct. 22, 2013 (JP) ..... 2013-218903

(51) Int. Cl.

| | |
|---|---|
| ***H01Q 1/50*** | (2006.01) |
| ***H01Q 21/28*** | (2006.01) |
| ***H01Q 1/52*** | (2006.01) |
| ***H01Q 9/42*** | (2006.01) |
| ***H01Q 5/335*** | (2015.01) |

(52) U.S. Cl.

CPC ..... *H01Q 21/28* (2013.01); *H01Q 1/521* (2013.01); *H01Q 5/335* (2015.01); *H01Q 9/42* (2013.01)

(58) Field of Classification Search

CPC ..... H01Q 1/521; H01Q 9/42; H01Q 21/28; H01Q 5/335
USPC ..... 343/702, 852
See application file for complete search history.

(56) References Cited

U.S. PATENT DOCUMENTS

| | | | | |
|---|---|---|---|---|
| 2008/0258991 | A1 | 10/2008 | Montgomery et al. | |
| 2011/0116404 | A1 | 5/2011 | Shimizu | |
| 2012/0299792 | A1 | 11/2012 | Montgomery et al. | |
| 2014/0159986 | A1* | 6/2014 | De Luis ..... | H01Q 1/50 343/852 |

FOREIGN PATENT DOCUMENTS

| | | | |
|---|---|---|---|
| JP | 2008-113233 | A | 5/2008 |
| JP | 2009-521898 | A | 6/2009 |

(Continued)

OTHER PUBLICATIONS

Tang et al., Tunable Decoupling and Matching Network for Diversity Enhancement of Closed Spaced Antennas, IEEE Antennasand Wireless Propagation Letters, vol. 11, 2012, pp. 268-271.*

*Primary Examiner* — Dieu H Duong
(74) *Attorney, Agent, or Firm* — Studebaker & Brackett PC

(57) ABSTRACT

In an antenna device, power is fed from a first port to a first radiation element, and power is fed from a second port to a second radiation element. A decoupling circuit connects the first radiation element and the second radiation element, and includes a bridge element connecting a first point between the first port and the first radiation element and a second point between the second port and the second radiation element to each other. A first reactance element is provided in series with the first radiation element between the first point and the first radiation element, and a second reactance element is provided in series with the second radiation element between the second point and the second radiation element. At least one of the first reactance element and the second reactance element is configured so as to be capable of changing the value of reactance.

5 Claims, 5 Drawing Sheets

(56) References Cited

FOREIGN PATENT DOCUMENTS

| | | | |
|---|---|---|---|
| JP | 2010-525680 | A | 7/2010 |
| JP | 2011-109440 | A | 6/2011 |
| JP | 2011-205316 | A | 10/2011 |
| WO | 2008/053726 | A1 | 5/2008 |

* cited by examiner

| | S21 | S11 | L1,L2 | LB |
|---|---|---|---|---|
| INITIAL STATE Q0 | ━━━━ | - - - - - - | 3.28nH | 3.52nH |
| FIRST STATE Q1 | ━━━━ | - - - - - - - - | 6.10nH | |
| SECOND STATE Q2 | ———— | ..... | 1.25nH | |

| | S21 | S11 | L1,L2 | LB |
|---|---|---|---|---|
| INITIAL STATE Q0 | ━━━━ | - - - - - - | 3.28nH | 3.52nH |
| FIRST STATE Q1 | ━━━━ | - - - - - - - - | | 13.0nH |
| SECOND STATE Q2 | ──── | ····· | | 27pF |

ANTENNA DEVICE

CROSS REFERENCE TO RELATED APPLICATIONS

The present application claims priority to Japanese Patent Application No. 2012-240832 filed on Oct. 31, 2012, and to Japanese Patent Application No. 2013-218903 filed on Oct. 22, 2013, the entire contents of each of these applications being incorporated herein by reference in their entirety.

TECHNICAL FIELD

The technical field relates to an antenna device that includes a plurality of radiation elements and where isolation between radiation elements is enhanced.

BACKGROUND

Owing to a MIMO (Multi-Input Multi-Output) transmission technology where a plurality of radiation elements are installed on both of a transmitting side and a receiving side and spatial multiplexing is performed, it may be possible to perform high-speed and high-capacity wireless communication. Lowering of coupling and lowering of a correlation between a plurality of radiation elements are desired for a MIMO antenna. In Japanese Unexamined Patent Application Publication No. 2011-109440, Japanese Unexamined Patent Application Publication No. 2011-205316, Japanese Unexamined Patent Application Publication No. 2009-521898 (Translation of PCT Application), or Japanese Unexamined Patent Application Publication No. 2010-525680 (Translation of PCT Application), a technique has been disclosed where coupling between antenna elements is reduced by connecting two antenna elements to each other using a connection element. In the technique disclosed in Japanese Unexamined Patent Application Publication No. 2011-109440, as a connection element used for lowering of coupling, a variable reactance circuit is used.

SUMMARY

The present disclosure provides an antenna device capable of easily shifting an operating frequency band in a state where isolation between two radiation elements is maintained at a high level.

According to an embodiment of the present disclosure, an antenna device includes a first radiation element, a second radiation element, a first port configured to feed power to the first radiation element, a second port configured to feed power to the second radiation element, and a decoupling circuit configured to connect the first radiation element and the second radiation element. The decoupling circuit includes a bridge element connecting a first point between the first port and the first radiation element and a second point between the second port and the second radiation element to each other, a first reactance element provided in series with the first radiation element between the first point and the first radiation element, and a second reactance element provided in series with the second radiation element between the second point and the second radiation element, and at least one of the first reactance element and the second reactance element is capable of changing a value of reactance.

In a more specific embodiment, each of the first radiation element and the second radiation element may also be configured so as to resonate in a first frequency band and a second frequency band higher than the first frequency band.

In another more specific embodiment, a configuration is adopted where a first matching circuit inserted between the first port and the first point and a second matching circuit inserted between the second port and the second point are included. Each of the first matching circuit and the second matching circuit may be configured so as to achieve impedance matching in the first frequency band and the second frequency band.

Other features, elements, characteristics and advantages will become more apparent from the following detailed description with reference to the attached drawings.

DETAILED DESCRIPTION

The inventor realized that in a technique of the related art, it has been difficult to shift an operating frequency band. A technique according to the present disclosure that shifts a frequency band in which an antenna device operates will now be described.

Figure 1A:
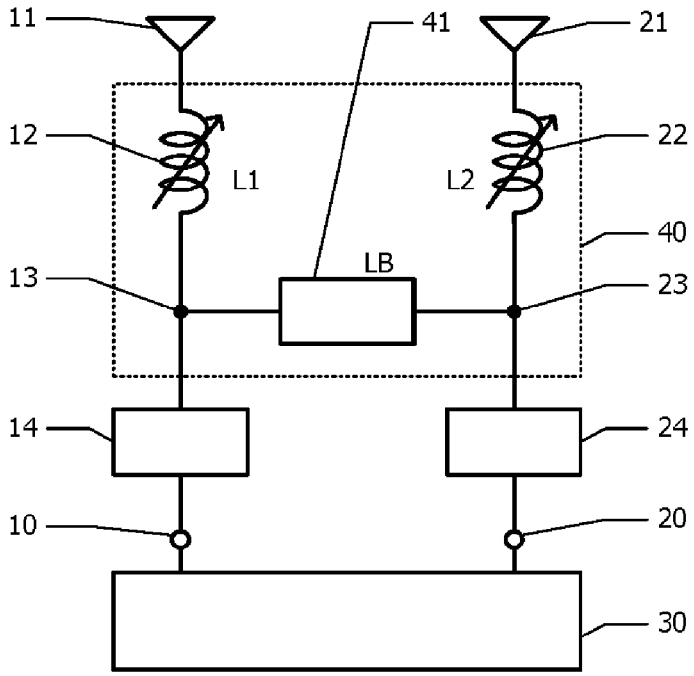
FIG. 1A is an equivalent circuit diagram of an antenna device according to a first embodiment.

FIG. 1A illustrates the equivalent circuit diagram of an antenna device according to a first exemplary embodiment. Power is fed from the first port 10 of the antenna device to a first radiation element 11, and power is fed from the second port 20 thereof to a second radiation element 21. The first radiation element 11 and the second radiation element 21 are configured so as to resonate at a single resonant frequency. The first port 10 and the second port 20 are connected to a transmission and reception circuit 30. The transmission and reception circuit 30 is compatible with, for example, an MIMO transmission system. A decoupling circuit 40 connects the first port 10, the second port 20, the first radiation element 11, and the second radiation element 21 to one another.

The decoupling circuit 40 includes a bridge element 41, a first reactance element 12, and a second reactance element 22. The bridge element 41 connects a first point 13 between the first port 10 and the first radiation element 11 and a second point 23 between the second port 20 and the second radiation element 21 to each other. The first reactance element 12 is inserted in series with the first radiation element 11 between the first point 13 and the first radiation element 11. The second reactance element 22 is inserted in series with the second radiation element 21 between the second point 23 and the second radiation element 21.

At least one of the first reactance element 12 and the second reactance element 22 is configured so as to be capable of changing the value of reactance. As an example, variable inductors or variable capacitors are used for the first reactance element 12 and the second reactance element 22. In addition, in each of the first reactance element 12 and the second reactance element 22, a plurality of fixed inductors may also be disposed whose inductances are different, and one fixed inductor may also be selected using a switch. A fixed inductor or a fixed capacitor is used for the bridge element 41.

A first matching circuit 14 is inserted between the first port 10 and the first point 13, and a second matching circuit 24 is inserted between the second port 20 and the second point 23.

A return loss when power is fed from the first port 10 to the first radiation element 11 is expressed as S11, and a transmission coefficient with the second port 20 is expressed as S21. In addition, a return loss when power is fed from the second port 20 to the second radiation element 21 is expressed as S22, and a transmission coefficient with the first port 10 is expressed as S12. The decoupling circuit 40 reduces the transmission coefficients S21 and S12. In other words, isolation between the first radiation element 11 and the second radiation element 21 is enhanced.

Figure 1B:
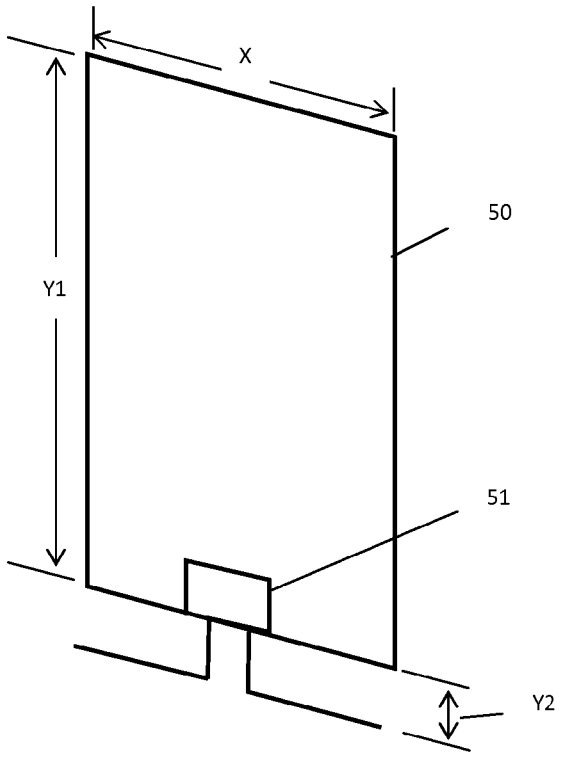
FIG. 1B is a schematic perspective view of the antenna device according to the first exemplary embodiment.

FIG. 1B illustrates the schematic perspective view of the antenna device according to the first embodiment. In the vicinity of the edge of a ground plate 50 having a substantially planar shape of a substantially rectangle shape, a high-frequency circuit 51 is disposed. The high-frequency circuit 51 includes the decoupling circuit 40, the first matching circuit 14, the second matching circuit 24 (FIG. 1A), and transmission lines connecting these circuits. The transmission line is configured using, for example, a microstrip line. A reactance element and a capacitance element, included in the high-frequency circuit 51, are configured using lumped parameter elements or distributed constant circuits.

For example, planar monopole antennas are used for the first radiation element 11 and the second radiation element 21. The first radiation element 11 and the second radiation element 21 are disposed in a slightly outer side portion of one side of the ground plate 50. One end of each of the first radiation element 11 and the second radiation element 21 is connected to the high-frequency circuit 51.

As a substrate for forming the ground plate 50, a dielectric plate such as, for example, a glass epoxy resin can be used. For example, an ABS resin can be used for a carrier for forming the first radiation element 11 and the second radiation element 21. In FIG. 1B, no dielectric plate and no carrier are illustrated.

The S parameters of the antenna device according to the first embodiment were calculated owing to simulation. As a condition for the simulation, it was assumed that a dimension Y1 in the vertical direction of the ground plate 50 illustrated in FIG. 1B and a dimension X in the lateral direction thereof were about 100 mm and about 60 mm, respectively, and the thickness of the ground plate 50 was about 1 mm. It was assumed that a dimension Y2 in the vertical direction of an antenna region in which the first radiation element 11 and the second radiation element 21 are disposed and a dimension X in the lateral direction thereof were about 10 mm and about 60 mm, respectively. The first radiation element 11 and the second radiation element 21 have geometric forms substantially plane-symmetrical with respect to each other. The length of each of the first radiation element 11 and the second radiation element 21 is about 27.4 mm, and a distance between the two is about 5.2 mm. Copper was used for the ground plate 50, the first radiation element 11, and the second radiation element 21.

Each of the first radiation element 11 and the second radiation element 21 is configured so as to resonate at a single resonant frequency of about 850 MHz. The decoupling circuit 40 illustrated in FIG. 1A was configured so that the transmission coefficient S21 becomes a local minimum at a frequency of about 850 MHz. Specifically, inductors L1 and L2 are used for the first reactance element 12 and the second reactance element 22, respectively, and both the inductances thereof are about 3.28 nH. An inductor LB is also used for the bridge element 41, and the inductance thereof is about 3.52 nH.

The first matching circuit 14 and the second matching circuit 24 were configured so that the return losses S11 and S22 become local minimums at a frequency of about 850 MHz. Specifically, the first matching circuit 14 and the second matching circuit 24 were configured using shunt inductances of about 6.5 nH and series capacitances of about 5.0 pF. It is assumed that the above-mentioned state is referred to as an initial state Q0.

Under the condition that the transmission coefficients S21 and S12 represent local minimum values at a frequency of about 750 MHz lower than about 850 MHz, the element constants of the first reactance element 12 and the second reactance element 22 were calculated. At this time, the circuit constants of the bridge element 41, the first matching circuit 14, and the second matching circuit 24 are not changed. Under the above-mentioned condition, the inductances of the first reactance element 12 and the second reactance element 22 were about 6.10 nH. It is assumed that this state is referred to as a first state Q1.

In the same way, under the condition that the transmission coefficients S21 and S12 represent local minimum values at a frequency of about 950 MHz higher than about 850 MHz, the element constants of the first reactance element 12 and the second reactance element 22 were calculated. As a result, the inductances of the first reactance element 12 and the second reactance element 22 were about 1.25 nH. It is assumed that this state is referred to as a second state Q2.

Figure 2:
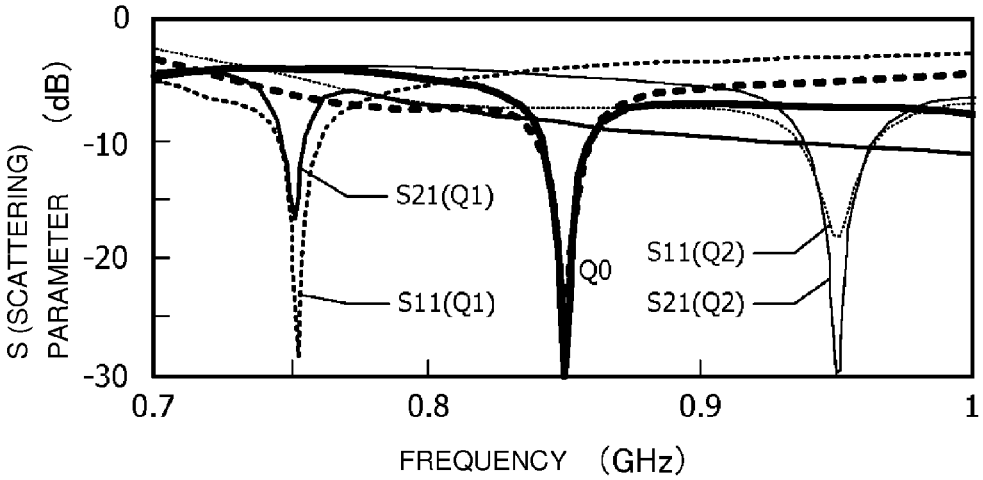
FIG. 2 is a graph illustrating simulation results of S (Scattering) parameters in an initial state, a first state, and a second state of the antenna device according to the first embodiment.

FIG. 2 illustrates simulation results of S (Scattering) parameters of the antenna device at the times of the initial state Q0, the first state Q1, and the second state Q2. In a horizontal axis, a frequency is expressed in unit of "GHz", and in a vertical axis, the magnitudes of S (Scattering) parameters are expressed in unit of "dB". Solid lines illustrated in FIG. 2 indicate the transmission coefficient S21, and dashed lines indicate the return loss S11. The thickest lines indicate the initial state Q0, the second thickest lines indicate the first state Q1, and the thinnest lines indicate the second state Q2. In the initial state Q0, both of the transmission coefficient S21 and the return loss S11 represent local minimum values at a frequency of about 850 MHz, according to design targets. In addition, owing to the substantial symmetry of radiation elements and circuits, the return loss S22 is approximately equal to the return loss S11, and the transmission coefficient S12 is approximately equal to the transmission coefficient S21.

In the first state Q1, the transmission coefficient S21 represents a local minimum value at about 750 MHz, according to a design target. At this time, the return loss S11 also represents a local minimum value at about 750 MHz. Therefore, at the time of the first state Q1, it may be possible for the antenna device to efficiently operate in a frequency band located near a frequency of about 750 MHz.

In the second state Q2, the transmission coefficient S21 represents a local minimum value at about 950 MHz, according to a design target. At this time, the return loss S11 also represents a local minimum value at about 950 MHz. Therefore, at the time of the second state Q2, it may be possible for the antenna device to efficiently operate in a frequency band located near a frequency of about 950 MHz.

Figure 3:
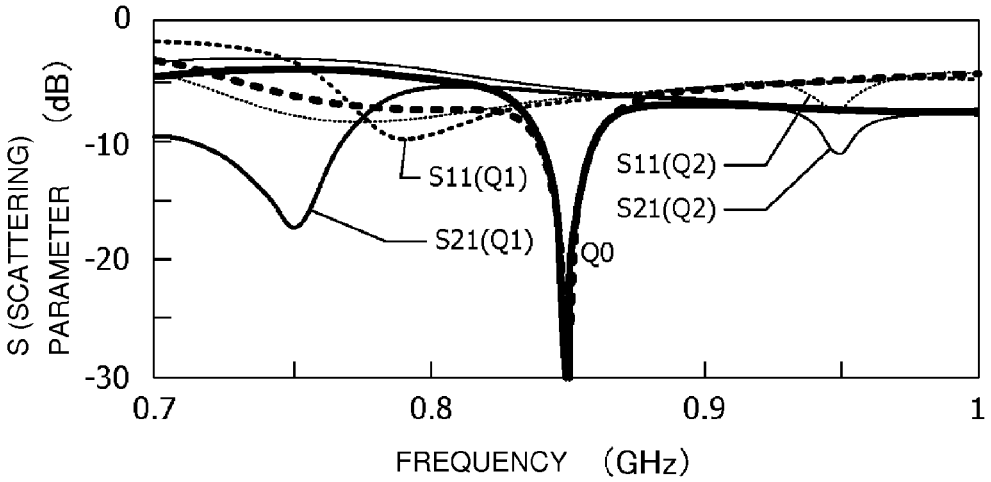
FIG. 3 is a graph illustrating simulation results of S (Scattering) parameters of an antenna device according to a comparative example.

With reference to FIG. 3, the simulation results of the S (Scattering) parameters of an antenna device according to a comparative example will be described. In the comparative example, the inductances of the inductors L1 and L2 in the first reactance element 12 and the second reactance element 22 illustrated in FIG. 1A were fixed, and the circuit constant of the bridge element 41 was changed. The initial state Q0 of the antenna device in the comparative example is approximately the same as the initial state Q0 of the antenna device (FIG. 1A, FIG. 1B, and FIG. 2) according to the first embodiment.

When the circuit constant of the bridge element 41 was calculated under the condition that the transmission coefficients S21 and S12 represent local minimum values at about 750 MHz (the first state Q1), the inductance of the bridge element 41 was about 13.0 nH. When the circuit constant of the bridge element 41 was calculated under the condition that the transmission coefficients S21 and S12 represent local minimum values at about 950 MHz (the second state Q2), the bridge element 41 changed to a capacitive property, and the capacitance thereof was about 27 pF.

FIG. 3 illustrates the simulation results of the S (Scattering) parameters of the antenna device according to the comparative example at the times of the initial state Q0, the first state Q1, and the second state Q2. In a horizontal axis, a frequency is expressed in unit of "GHz", and in a vertical axis, the magnitudes of S (Scattering) parameters are expressed in unit of "dB". Solid lines illustrated in FIG. 3 indicate the transmission coefficient S21, and dashed lines indicate the return loss S11. The thickest line indicates the initial state Q0, the second thickest line indicates the first state Q1, and the thinnest line indicates the second state Q2.

In the first state Q1, the transmission coefficient S21 represents a local minimum value at about 750 MHz, according to a design target. However, the return loss S11 represents a local minimum value at about 780 MHz, and is deviated away from a frequency at which the transmission coefficient S21 takes a local minimum value. Since the return loss S11 is large at about 750 MHz, the antenna device according to the comparative example is not suitable for an operation in a frequency band located near about 750 MHz.

In the second state Q2, the transmission coefficient S21 represents a local minimum value at about 950 MHz, according to a design target. In addition, the return loss S11 also represents a local minimum value at about 950 MHz. However, compared with the S (Scattering) parameters in the second state Q2 in FIG. 2, it is understood that valleys are shallow that occur at about 950 MHz in the second state Q2 of the antenna device according to the comparative example. In other words, compared with the second state Q2 of the antenna device according to the first embodiment illustrated in FIG. 2, isolation between the first port 10 and the second port 20 (FIG. 1A) is weak, and the return loss S11 is large. Therefore, the antenna device according to the comparative example is not suitable for an operation in a frequency band located near about 950 MHz.

As described above, in the antenna device according to the first embodiment, the circuit constant of the bridge element 41 illustrated in FIG. 1A is fixed, and the circuit constants of the first reactance element 12 and the second reactance element 22 are made variable. Owing to this, it may become possible to shift a frequency band in which the antenna device operates, and after the operating frequency band has been shifted, it may be possible to maintain the small transmission coefficient S21 (high isolation) and the small return loss S11.

Furthermore, in the first embodiment, in order to change the operating frequency band from about 750 MHz to about 950 MHz, it is only necessary to change the inductances of the inductors L1 and L2 from about 1.25 nH to about 6.10 nH. The amount of change therein is about 4.85 nH. On the other hand, in the comparative example illustrated in FIG. 3, in order to change the operating frequency band from about 850 MHz to about 750 MHz, it is necessary to change the inductance of the bridge element 41 from about 3.52 nH to about 13.0 nH, and the amount of change therein is about 9.48 nH. Furthermore, in the comparative example, in order to change the operating frequency band from about 850 MHz to about 950 MHz, it is necessary to change the bridge element 41 from an induction property to a capacitive property. In this way, in the first embodiment, compared with the comparative example, it may be possible to reduce the amount of change in a circuit constant, which is used for shifting the operating frequency band.

Figure 4A:
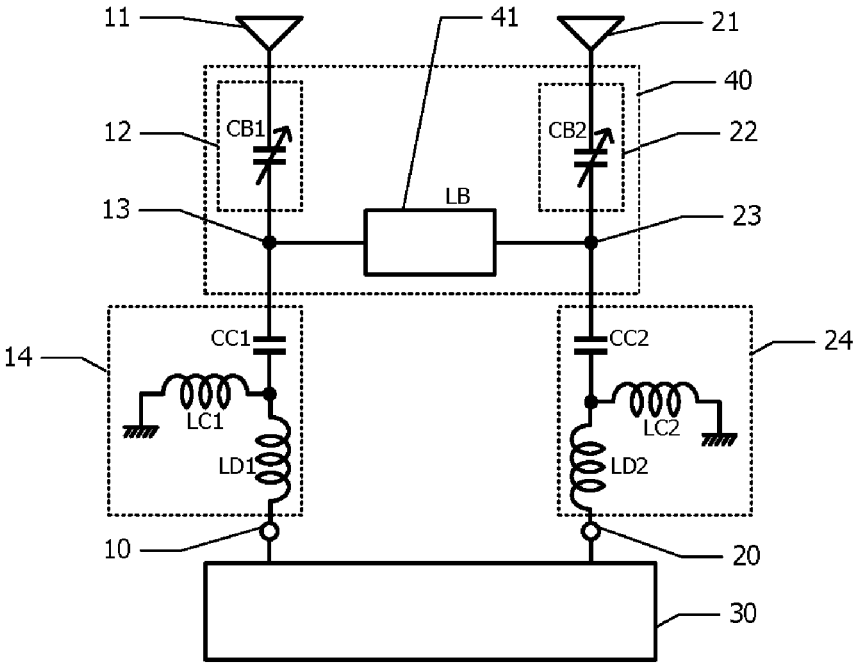
FIG. 4A is an equivalent circuit diagram of an antenna device according to a second exemplary embodiment.
Figure 4B:
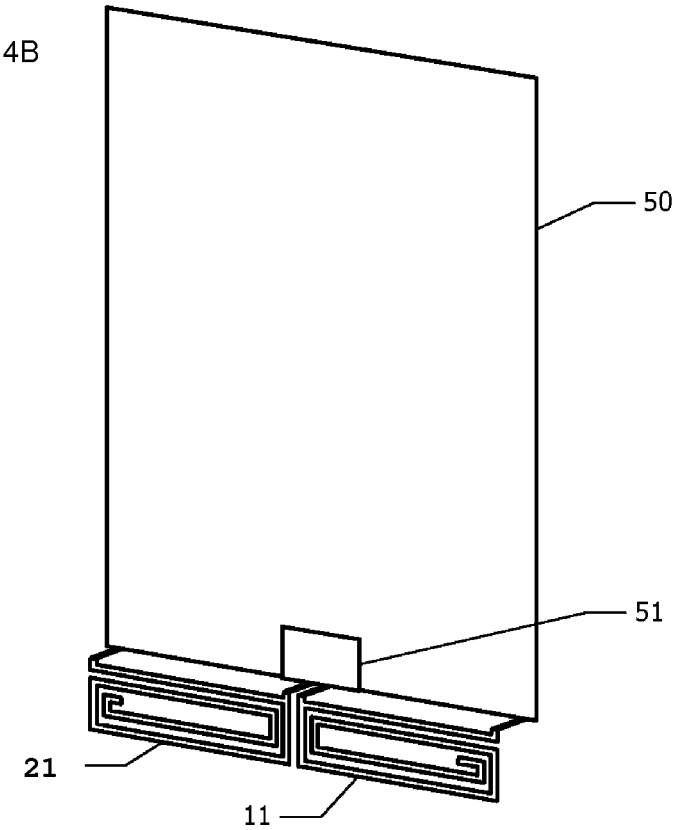
FIG. 4B is a schematic perspective view of the antenna device according to the second embodiment.
Figure 5:
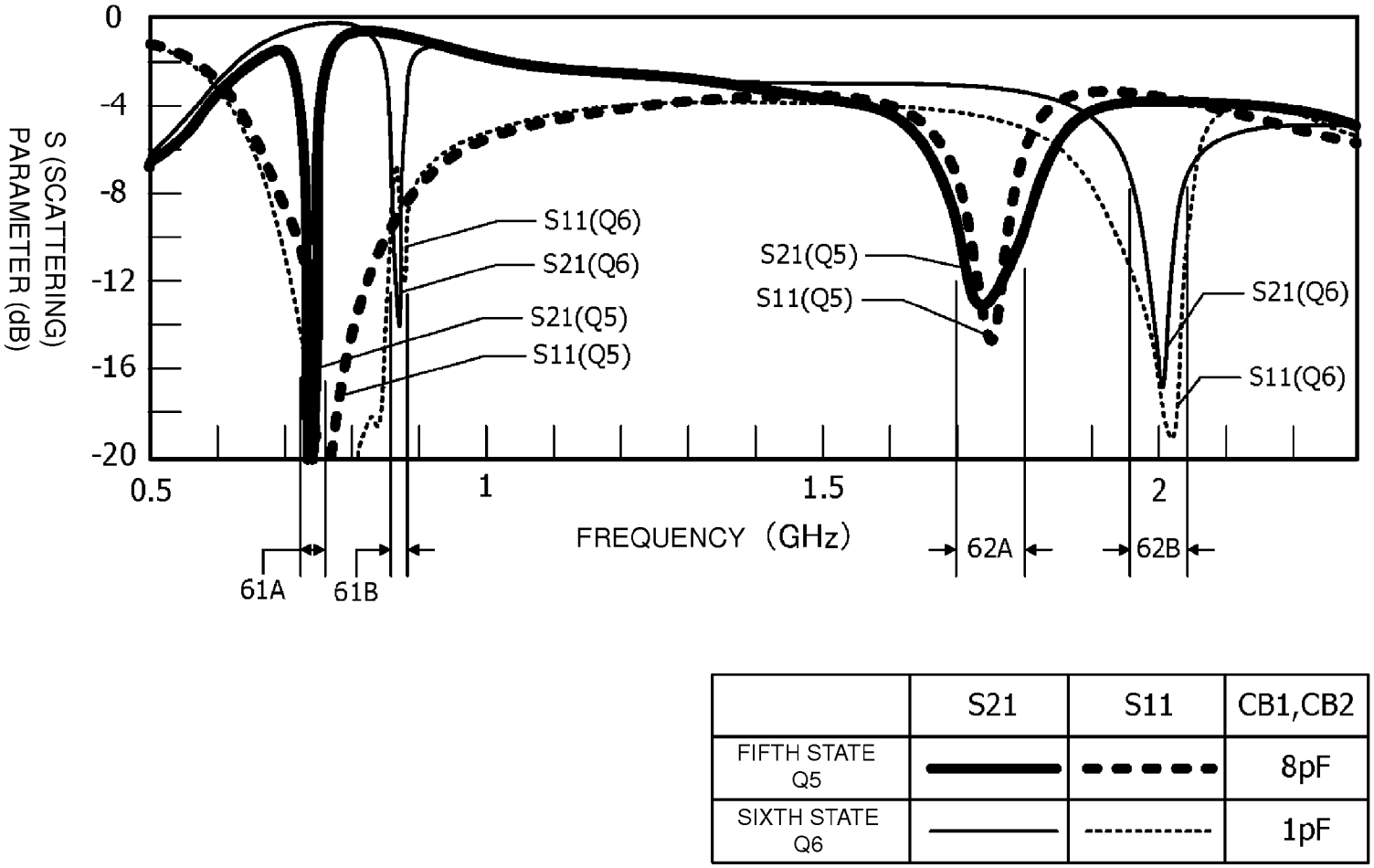
FIG. 5 is a graph illustrating simulation results of S (Scattering) parameters in a fifth state and a sixth state of the antenna device according to the second embodiment.

With reference to FIG. 4A, FIG. 4B, and FIG. 5, an antenna device according to a second exemplary embodiment will be described. Hereinafter, a difference from the first embodiment will be described, and the description of the same configuration described above will not be repeated. In the first embodiment, the first radiation element 11 and the second radiation element 21 (FIG. 1B) are configured so as to resonate at a single resonant frequency. In the second embodiment, the first radiation element 11 and the second radiation element 21 are configured so as to resonate at two resonant frequencies. As an example, in the first radiation element 11 and the second radiation element 21, two-resonance characteristics are obtained using a fundamental and a harmonic.

FIG. 4A illustrates the equivalent circuit diagram of the antenna device according to the second embodiment. In the second embodiment, as described above, the first radiation element 11 and the second radiation element 21 have two-resonance characteristics. Variable capacitors CB1 and CB2 are used for the first reactance element 12 and the second reactance element 22, respectively. A T-type circuit is used for the first matching circuit 14, and the first matching circuit 14 includes a series inductor LD1, a shunt inductor LC1, and a series capacitor CC1. As an example, the inductance of the series inductor LD1 is about 1.5 nH, the inductance of the shunt inductor LC1 is about 9 nH, and the capacitance of the series capacitor CC1 is about 5 pF. The second matching circuit 24 also has the same configuration, and includes a series inductor LD2, a shunt inductor LC2, and a series capacitor CC2. An inductor LB is used for the bridge element 41, and the inductance thereof is about 4 nH.

FIG. 4B illustrates the schematic perspective view of the antenna device according to the second embodiment. As the first radiation element 11 and the second radiation element 21, inverted-F antennas are used. The transmission and reception circuit 30 (FIG. 4A) feeds power to the feeding points of the first radiation element 11 and the second radiation element 21 through the high-frequency circuit 51.

The circuit constants of the first reactance element 12 and the second reactance element 22 were changed, and the S (Scattering) parameters of the antenna device were calculated owing to simulation. It is assumed that a state where the capacitances of the variable capacitors CB1 and CB2 in the first reactance element 12 and the second reactance element 22 are set to about 8 pF is referred to as a third state Q3 and a state where the capacitances of the variable capacitors CB1 and CB2 are set to about 1 pF is referred to as a fourth state Q4.

FIG. 5 illustrates the simulation results of the transmission coefficient S21 and the return loss S11 when the antenna device according to the second embodiment is in the third state Q3 and the fourth state Q4. In a horizontal axis, a frequency is expressed in unit of "GHz", and in a vertical axis, the magnitudes of S (Scattering) parameters are expressed in unit of "dB". Solid lines in FIG. 5 indicate the transmission coefficient S21, and dashed lines indicate the return loss S11. Thick lines indicate the third state Q3, and thin lines indicate the fourth state Q4.

When the antenna device is in the third state Q3, the transmission coefficient S21 and the return loss S11 represent local minimum values in a first frequency band 61A located near about 700 MHz. Furthermore, in a second frequency band 62A located near about 1.75 GHz, the transmission coefficient S21 and the return loss S11 represent local minimum values in a second frequency band 62A located near about 1.75 GHz. Therefore, when being in the third state Q3, the antenna device may efficiently operate in both of the first frequency band 61A and the second frequency band 62A.

When the antenna device is in the fourth state Q4, the transmission coefficient S21 and the return loss S11 represent local minimum values in a first frequency band 61B located near about 880 MHz. Furthermore, in a second frequency band 62B located near about 2 GHz, the transmission coefficient S21 and the return loss S11 represent local minimum values. Therefore, when being in the fourth state Q4, the antenna device may efficiently operate in both of the first frequency band 61B and the second frequency band 62B.

In the second embodiment, in the same way as the second embodiment, it may also be possible to shift operating frequency bands on both of the low-frequency wave side and the high-frequency wave side. Even if the operating frequency bands are shifted, it may be possible to maintain high isolation and a low return loss.

The first matching circuit 14 and the second matching circuit 24 are designed so as to achieve impedance matching in the first frequency bands 61A and 61B and the second frequency bands 62A and 62B.

With embodiments according to the present disclosure, by changing the value of the reactance of at least one of the first reactance element and the second reactance element, it is possible to shift a frequency at which a transmission coefficient between the first port and the second port becomes a local minimum. After the shift of the frequency, it is also possible to maintain a small return loss.

While exemplary embodiments have been described above, it is to be understood that variations, modifications, improvements, and combinations may occur without departing from the scope and spirit of the disclosure.

What is claimed is:

1. An antenna device comprising:

a first radiation element;

a second radiation element;

a first port configured to feed power to the first radiation element;

a second port configured to feed power to the second radiation element; and a decoupling circuit configured to connect the first radiation element and the second radiation element, wherein the decoupling circuit includes:

a bridge element connecting a first point between the first port and the first radiation element and a second point between the second port and the second radiation element to each other, a first reactance element provided in series with the first radiation element between the first point and the first radiation element, and a second reactance element provided in series with the second radiation element between the second point and the second radiation element, and at least one of the first reactance element and the second reactance element is capable of changing a value of reactance, and each of the first radiation element and the second radiation element is configured so as to resonate in a first frequency band and a second frequency band higher than the first frequency band.

2. The antenna device according to claim 1, further comprising:

a first matching circuit provided between the first port and a second matching circuit provided between the second port and the second point, wherein each of the first matching circuit and the second matching circuit is configured so as to achieve impedance matching in the first frequency band and the second frequency band.

3. The antenna device according to claim 1, wherein at least one of the first reactance element and the second reactance element is a variable reactance element.

4. The antenna device according to claim 3, wherein each of the first reactance element and the second reactance element is a variable reactance element.

5. The antenna device according to claim 3, wherein the variable reactance element is an inductor.

* * * * *